US006973978B2

(12) United States Patent
Cravatte

(10) Patent No.: US 6,973,978 B2
(45) Date of Patent: Dec. 13, 2005

(54) DRILLING TOOL HAVING AN EXPANDABLE BLADDER AND METHOD FOR USING SAME

(75) Inventor: Philippe Louis Cravatte, Aberdeen (GB)

(73) Assignee: Varel International, Ltd., Carrollton, TX (US)

( * ) Notice: Subject to any disclaimer, the term of this patent is extended or adjusted under 35 U.S.C. 154(b) by 0 days.

(21) Appl. No.: 10/422,010

(22) Filed: Apr. 23, 2003

(65) Prior Publication Data

US 2004/0211597 A1 Oct. 28, 2004

(51) Int. Cl.[7] ..... E21B 10/32; E21B 10/46

(52) U.S. Cl. ..... 175/57; 175/267; 175/292; 175/265; 175/434

(58) Field of Search ..... 175/19, 57, 267, 175/268, 292, 271, 265, 426, 434; 408/180, 408/147

(56) References Cited

U.S. PATENT DOCUMENTS

| | | | | |
|---|---|---|---|---|
| 3,180,437 A | | 4/1965 | Kellner et al. | 175/230 |
| 4,503,919 A | | 3/1985 | Suied | 175/269 |
| 5,090,480 A | * | 2/1992 | Pittard et al. | 166/298 |
| 5,226,487 A | * | 7/1993 | Spektor | 175/19 |
| 6,189,631 B1 | | 2/2001 | Sheshtawy | 175/284 |
| 6,732,817 B2 | * | 5/2004 | Dewey et al. | 175/57 |
| 2004/0208717 A1 | * | 10/2004 | Greenhalgh | 408/224 |

OTHER PUBLICATIONS

Notification of Transmittal of The International Search Report and the Written Opinion of International Application No. PCT/US2004/012372, filed Apr. 22, 2004, and authorized by Jean-Marie Geiswiller-Bouvet (12 pages), Aug. 25, 2004.

* cited by examiner

*Primary Examiner*—David Bagnell
*Assistant Examiner*—Shane Bomar
(74) *Attorney, Agent, or Firm*—Jenkens & Gilchrist, PC

(57) ABSTRACT

A drilling tool having an expandable bladder and a method for using the same are provided. The drilling tool includes a tool body having an interior cavity, a plurality of extendable arms coupled with the tool body, and an expandable bladder at least partially disposed within the interior cavity of the tool body. The expandable is operable to deploy the extendable arms from a retracted position relative to the exterior surface of the tool body to an extended position relative to the exterior surface of the tool body.

21 Claims, 2 Drawing Sheets

DRILLING TOOL HAVING AN EXPANDABLE BLADDER AND METHOD FOR USING SAME

TECHNICAL FIELD OF THE INVENTION

The present invention relates in general to the field of oil and gas drilling and, in particular, to a drilling tool having an expandable bladder and method for using the same.

BACKGROUND OF THE INVENTION

When drilling through subterranean formations in the exploration for oil and gas, it is a common practice to drill larger diameter holes at the surface, and successively smaller diameter holes as the well is drilled deeper, cementing in tubular casings at various depths along the well bore. However, it is often desirable to drill a hole larger than the inside diameter of the last casing that was set, at some known depth below the surface. Since conventional drill bits large enough to generate the desired well bore diameter will not fit inside the casing that has already been set, special tools are used to drill a well bore diameter larger than the inside diameter of the casing. One such tool used for this purpose is an underreamer.

Underreamers typically include extendable arms that are pivotally mounted in a housing using hinge pins. The hinge pins allow for movement of the extendable arms between a retracted position and an extended position. While the underreamer is being lowered into the hole, these arms are retracted to allow the tool to pass through the inside diameter of the casing. Once at the desired depth, the arms of the underreamer are then hydraulically or mechanically actuated into the extended position, where they are used to drill a larger well bore.

Many traditional underreamer designs suffer from one or more limitations. One such limitation of previous underreamer designs has been the necessity to first drill a pilot hole with a conventional drill bit before beginning the underreaming operation. This is due to the fact that most underreamer designs cannot tolerate the shock and vibration associated with simultaneous drilling and instead disengage, returning to the retracted position.

Other underreamer designs incorporate long tubular sections that are internally tapered. Many of these designs suffer from operational limitations, as well as manufacturing difficulties, due to their quality tolerances.

SUMMARY OF THE INVENTION

In accordance with the present invention, a drilling tool having an expandable bladder and a method for using the same are provided. The drilling tool comprises a tool body having an interior cavity, a plurality of extendable arms coupled with the tool body, and an expandable bladder at least partially disposed within the interior cavity of the tool body. The expandable bladder is operable to deploy the extendable arms from a retracted position relative to the exterior surface of the tool body to an extended position relative to the exterior surface of the tool body. The method comprises expanding an expandable bladder that is at least partially disposed within a tool body having an interior cavity. The expandable bladder is operable to force a plurality of extendable arms coupled with the tool body outwards. Accordingly, the plurality of extendable arms are deployed from a retracted position relative to the exterior surface of the tool body to an extended position relative to the exterior surface of the tool body.

Technical advantages of particular embodiments of the present invention include a drilling tool that employs an expandable bladder to extend and/or retract cutting arms of the drilling tool. Such a drilling tool provides enhanced stability, fewer moving parts, and a higher degree of reliability than previous designs, which employed rigid, mechanical components.

Another technical advantage of particular embodiments of the present invention is that the drilling tool may be constructed with a shorter length than previous underreamer designs. This shorter length minimizes the influence the tool has on the steering capabilities of the drill string and reduces the load on the motor bearings of the drill string.

Yet another technical advantage of particular embodiments of the present invention is that the enhanced stability of the drilling tool also allows for a greater extension of the cutting arms and enables the operator of the drilling tool to expand the well bore in a greater amount than previous designs.

Another technical advantage of particular embodiments of the present invention is that the drilling tool allows operators to continue to drill a deeper hole while simultaneously enlarging the well bore. This may eliminate the need to drill a pilot hole with a conventional drill bit before beginning the underreaming operation.

Still another technical advantage of particular embodiments of the present invention is that the drilling tool has fewer flow-rate limitations than previous underreamer designs. When drilling conditions require a higher flow-rate, the drilling tool may be used with a drill bit with larger nozzles without damaging with the tool.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following descriptions, taken in conjunction with the accompanying drawings, in which.

DETAILED DESCRIPTION OF THE INVENTION

Figure 1:
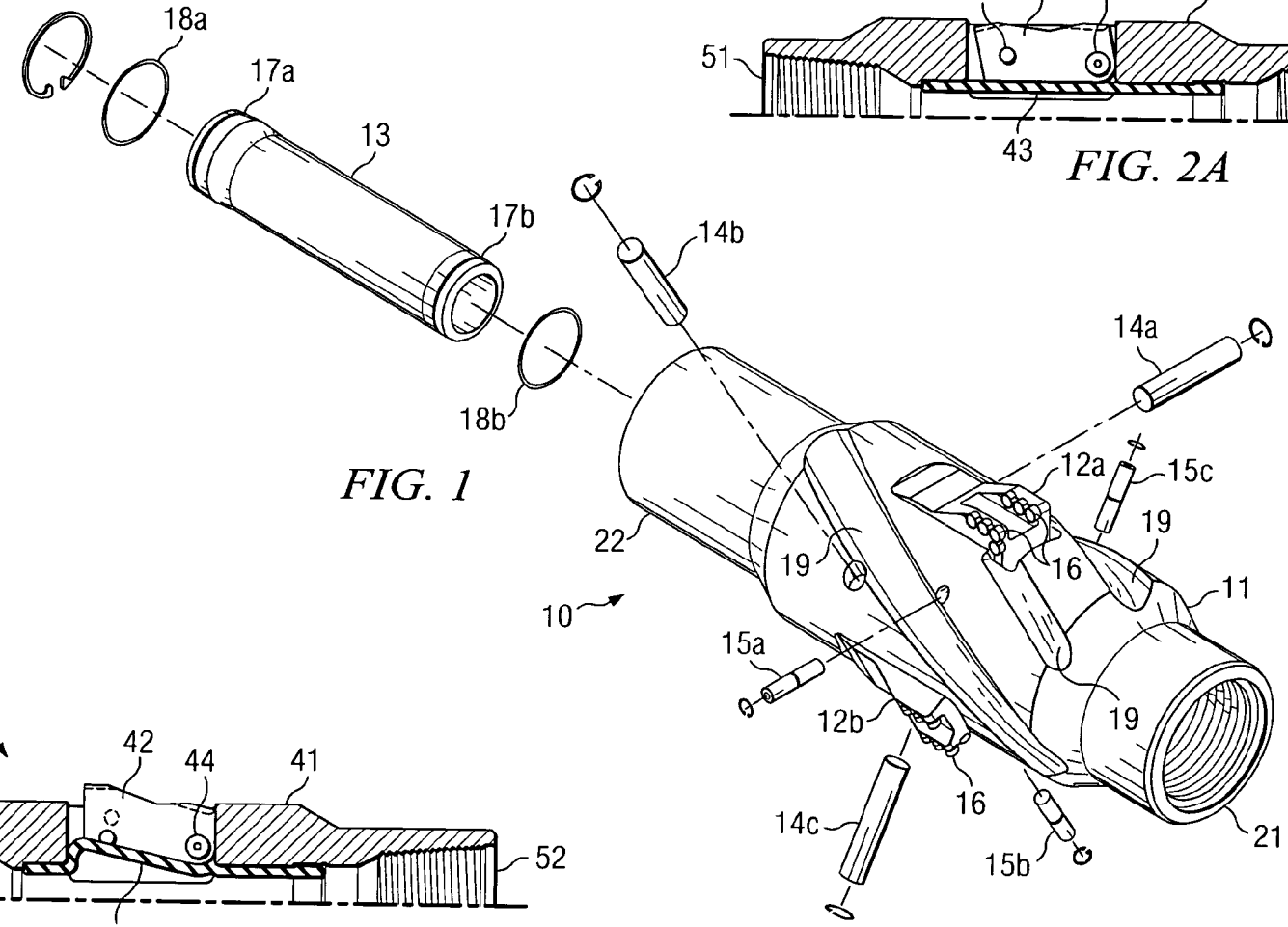
FIG. 1 is an exploded view, with portions broken away, illustrating a drilling tool having an expandable bladder that deploys extendable arms in accordance with a particular embodiment of the present invention.

FIG. 1 illustrates an exploded view of a drilling tool 10 in accordance with a particular embodiment of the present invention. Drilling tool 10, which may be referred to as an underreamer, may be used to bore a hole larger than the smallest diameter casing or up-hole well bore.

Drilling tool 10 includes an elongate, generally cylindrical tool body 11 that extends from a first end 21 to a second end 22. When drilling tool 10 is disposed within a well, it is oriented such that end 21 is down-hole from end 22. End 21 includes a threaded region which is configured to be threadably coupled with a drill bit or other drilling tool.

Drilling tool 10 also includes a threaded region at its second end 22. Second end 22 is configured to be coupled with a drill string or other drilling tool or component. Accordingly, drilling tool 10 is in fluid communication with the drill string during drilling operation.

The configuration of tool body 11 allows drilling tool 10 to be installed within a drill casing or well bore. One or more grooves 19 may be formed upon the exterior surface of tool body 11. Grooves 19 accommodate the flow of drilling fluid, water, and/or debris up-hole from drilling tool 10 during operation. In FIG. 1, grooves 19 are illustrated running spirally down tool body 11. In other embodiments, grooves could have other orientations, including running longitudinally down the sides of tool body 11.

Coupled with tool body 11 are extendable arms 12*a*, 12*b*, and 12*c* (not shown). The three extendable arms 12*a*– 12*c* are symmetrically positioned around tool body 11 and coupled with the tool body 11 with hinge pins 14*a*–14*c*, respectively. These hinge pins 14*a*–14*c* pivotally mount extendable arms 12*a*–12*c* in housings in tool body 11. Being pivotally mounted, extendable arms 12*a*–12*c* are operable to pivot from a retracted position with respect to the exterior surface of tool body 11 to an extended position with respect to the exterior of tool body 11. In FIG. 1, extendable arms 12*a*–12*b* are shown in the extended position.

Drilling tool 10 also includes expandable bladder 13. Disposed at least partially within the interior cavity of tool body 11, expandable bladder 13 is operable to deploy extendable arms 12*a*–12*c* from a retracted position to an extended position. Expandable bladder 13 is made from an elastomer and features steel rings 17*a* and 17*b* on its ends. Expandable bladder 13 is sealed against tool body 11 with ring-shaped seals 18*a* and 18*b*, so that drilling fluid may flow through drilling tool 10 through expandable bladder 13. Increasing the flow-rate of drilling fluid through drilling tool 10 increases the pressure drop at the bit coupled to end 21 of drilling tool 10. This increases the back pressure within drilling tool 10. This increasing pressure expands expandable bladder 13. The expansion of expandable bladder inside tool body 11 applies force to extendable arms 12*a*–12*c*, forcing extendable arms 12*a*–12*c* to pivot outward on hinge pins 14*a*–14*c*, respectively. Extendable arms 12*a*–12*c* pivot outwards until the arms butt against with the tops of their respective housings on the up-hole end of tool body 11, restraining their further extension.

To prevent premature deployment of extendable arms 12*a*–12*c*, drilling tool 10 also includes shear pins 15*a*–15*c*. Shear pins 15*a*–15*c* secure extendable arms 12*a*–12*c*, respectively, in the retracted position until some minimum force required to shear shear pins 15*a*–15*c* is reached. Once sheared, the broken halves of shear pins 15*a*–15*c* are retained in extendable arms 12*a*–12*c* and tool body 11, rather than falling into the well bore. The use of shear pins 15*a*–15*c* allows various drilling fluid flow-rates to be used with drilling tool 10 without deploying extendable arms 12*a*–12*c*, provided the shear pins 15*a*–15*c* are chosen appropriately.

Once extendable arms 12*a*–12*c* have been deployed, drilling tool 10 may be used to bore a hole larger than the smallest diameter casing or up-hole well bore. When used for this purpose, extendable arms 12*a*–12*c* include cutting elements 16, as shown FIG. 1. Cutting elements 16, which may include polycrystalline diamond compacts (PDC) or other suitable materials, allow drilling tool 10 to penetrate and cut through rock under the weight of the drill string. The weight from the drill string gives drilling tool 10 the force to penetrate and cut rock, while also assisting in keeping extendable arms 12*a*–12*c* deployed.

The size of the hole cut by drilling tool 10 is defined by the distance extendable arms 12*a*–12*c* extend from tool body 11 when deployed. This distance is defined by the amount of travel extendable arms 12*a*–12*c* have before they contact tool body 10 above (i.e., up-hole from) hinge pins 14*a*–14*c*, respectively.

As mentioned previously, extendable arms 12*a*–12*c* are positioned symmetrically around tool body 11. Positioning extendable arms 12*a*–12*c* symmetrically around tool body 11 offers the advantage of making drilling tool 11 "force balanced". This symmetrical arrangement reduces drill string vibrations that could destroy drilling tools or lower the quality of the well bore. Other embodiments could have other numbers of extendable arms. Provided that these arms are still symmetrically positioned around tool body 11, they would still benefit from being "force balanced"

In particular embodiments of the present invention, the drilling tool could also be used for stabilization purposes, to help control the vibration of the drill string and the direction of its drilling. In this way, the drilling tool functions as an expanding drill string stabilizer. In this configuration, the extendable arms of the drilling tool are replaced with stabilizing lugs. These stabilizing lugs may have a wear-resistant surface, such as hard metal, or attached wear elements, such as diamonds or tungsten carbide inserts. Furthermore, nozzles are selected for the drill bit being used with drilling tool 10 such that the nozzle size (smaller nozzle orifices cause larger back pressures) and the shear pins cooperate to deploy the arms at approximately a predetermined flow rate (i.e., predetermined back pressure).

Upon completion of the underreaming operation, extendable arms 12*a*–12*c* may be retracted to allow drilling tool 10 to be removed from the well bore. Extendable arms 12*a* and 12*b* feature a steep bevel on their up-hole side that facilitates this retraction. Upon completion of the underreaming operation, the flow-rate of drilling fluid through drilling tool 10 is decreased to a level that will allow expandable bladder 13 to contract from its expanded state. Without expandable bladder 13 forcing extendable arms 12*a*–12*c* outward, whenever extendable arms 12*a*–12*c* meet any restriction as drill tool 10 is brought up the well bore or pulled out of the well, the restriction will force extendable arms 12*a*–12*c* to close naturally because of their beveled shape. Furthermore, in addition to being used to deploy extendable arms 12*a*–12*c*, the elasticity of the expandable bladder 13 could be used to assist in retracting extendable arms 12*a*–12*c* as well.

Figure 2A:
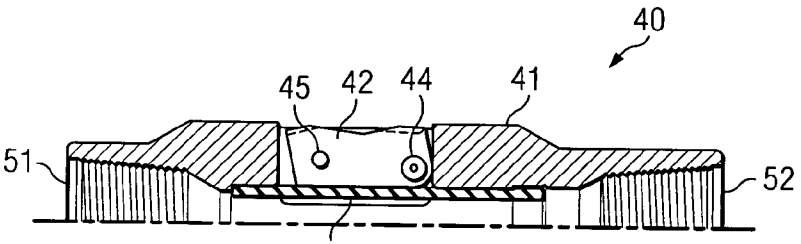
FIG. 2A is a longitudinal cross-section, with portions broken away, illustrating a drilling tool having an expandable bladder with its extendable arms retracted.

FIG. 2A illustrates a cut-away view of drilling tool 40 in accordance with a particular embodiment of the present invention. Drilling tool 40 is comprised of tool body 41, extendable arm 42, and expandable bladder 42. In FIG. 2A, drilling tool 40 is shown retracted, in the vertical position, as it would be lowered down a well, with end 51 coupled to a drill bit, end 52 coupled to the remainder of the drill string, and extendable arm 42 in the retracted position. Extendable arm 42 is coupled with tool body 41 by hinge pin 44, and is operable to pivot around hinge pin 44. Inside tool body 41, expandable bladder 43 is operable to deploy extendable arm 42. However, extendable arm 42 is held in the retracted position by shear pin 45.

Figure 2B:
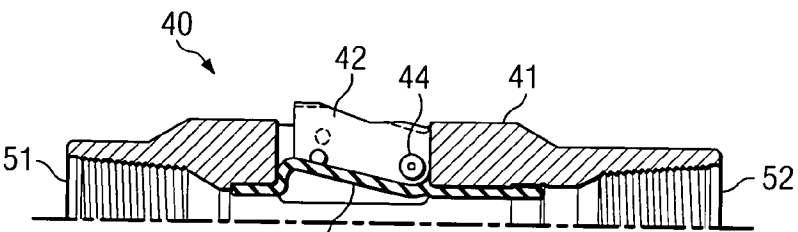
FIG. 2B is a longitudinal cross-section, with portions broken away, illustrating a drilling tool having an expandable bladder with its extendable arms deployed.

FIG. 2B also illustrates a cut-away view of drilling tool 40; however in FIG. 2B, extendable arm 42 is in the deployed position. In this position, shear pin 45 has been sheared and no longer restrains extendable arm 42. This allows extendable arm 42 to pivot around hinge pin 44, extendable arm 42 being forced outward by expandable bladder 43, until extendable arm 42 comes in contact with tool body 41 above hinge pin 44.

In other embodiments of the present invention, alternative methods of restraining the extendable arms prior to deployment may also be employed instead of, or in addition to, using shear pins. One such method includes using a rigid sleeve located inside the expandable bladder to isolate the bladder from increased pressure until the desired time of activation. In some embodiments, this isolation has the added benefit of lessening the risk of premature deployment of the extendable arms due to bit plugging.

Figure 3A:
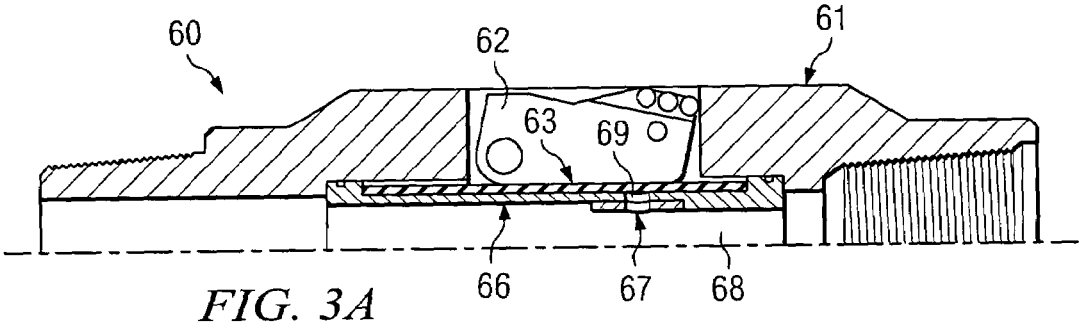
FIG. 3A is a longitudinal cross-section, with portions broken away, illustrating a drilling tool having an expandable bladder employing a rupture disk activation mechanism.

FIG. 3A shows a particular embodiment of the present invention employing rigid sleeve 66 to isolate expandable bladder 63 from pressure. In this embodiment, sleeve 66 is disposed within the interior cavity 68 of the tool body, within the expandable bladder 63. Sleeve 66 separates interior cavity 68 into two regions: an inner region in fluid communication with the drill string, and an outer region, which includes expandable bladder 63, that is isolated from the increasing pressure within the drilling tool. These two regions are connected by port 69, which provides a path of fluid communication between the inner region of interior cavity 68 and the interior surface of expandable bladder 63 on the other side of sleeve 66.

Prior to activation, port 69 is covered by rupture disk 67, which prevents the pressure inside interior cavity 68 from being directly applied to expandable bladder 63. Rupture disk 67 is chosen so that it will rupture when exposed to some minimum pressure. When the pressure drop across interior cavity 68 becomes sufficient to burst rupture disk 67, the pressure inside interior cavity 68 is transferred through port 69, expanding expandable bladder 63 and forcing extendable arm 62 outwards.

Figure 3B:
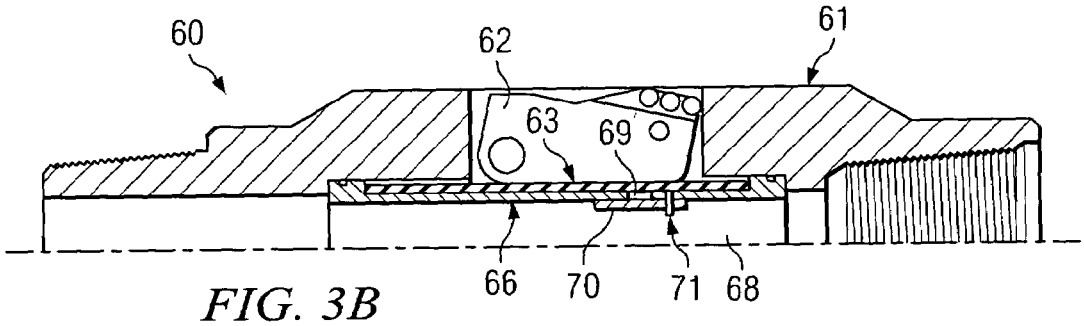
FIG. 3B is a longitudinal cross-section, with portions broken away, illustrating a drilling tool having an expandable bladder employing a piston-type activation mechanism.

In an alternative embodiment, a piston 70 could be used to cover port 69, as shown in FIG. 3B. In this configuration, piston 70 is held in position, covering port 69, by shear pin 71. Only when the pressure inside interior cavity 68 is sufficient to shear shear pin 71 does piston 70 slide down, uncovering port 69. Aiding this deployment, a plastic ball could also be dropped down the drill string. When the ball comes to rest on the top of piston 70, it will create a significant pressure increase inside the drilling tool. This pressure increase will shear shear pin 71 and force piston 70 down, uncovering port 69. With port 69 no longer covered, the pressure inside the drilling tool is transferred to expandable bladder 63, expanding the bladder 63 and deploying extendable arm 62. This embodiment, in particular, offers the added benefit of lessening the risk of premature deployment of the extendable arms due to bit plugging.

Particular embodiments of the present invention offer a variety of technical advantages. For one, as a result of the stability of the drilling tool and its unique internal assembly, the risk of breakage and disaster is substantially reduced. The increased stability also allows for a greater extension of the extendable arms, in some embodiments up to 20% beyond the exterior surface of the tool body. The greater strength and stability of the tool also allows an operator to drill a deeper hole while simultaneously enlarging the well bore. This eliminates the need to drill a pilot hole with a conventional drill bit, then remove the entire drill string, assemble an underreamer onto the drill string, and then begin the underreaming operation.

As mentioned previously, particular embodiments of the present invention also offer the advantage of being "force balanced". By positioning the extendable arms symmetrically around the body of the drilling tool, this reduces drill string vibrations that could destroy tools or lower the quality of the well bore.

Particular embodiments of the present invention also offer the added benefit of having minimal flow-rate limitations. Whenever drilling conditions necessitate a higher flow-rate, larger nozzles may simply be used with the drill bit, having no detriment to the drill bit or the drilling tool.

Particular embodiments of the present invention are also much shorter than previous underreamer designs, due to the underreamer's compact internal assembly and minimal number of parts. This short length helps to minimize the influence the tool has on the steering capabilities of the drill string and reduces the load on the motor bearings of the drill string.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications, and substitutions without departing from the spirit of the invention as set forth and defined by the following claims.

What is claimed is:

1. A drilling tool, comprising:

a tool body, the tool body defining an interior cavity and having a generally cylindrical exterior surface;

a plurality of extendable arms pivotally coupled with the tool body;

the extendable arms each having a first position in which the extendable arms are retracted with respect to the exterior surface of the tool body, and a second position in which the extendable arms are extended with respect to the exterior surface of the tool body;

an expandable bladder at least partially disposed within the interior cavity of the tool body; and wherein the expandable bladder is operable to pivotally deploy the plurality of extendable arms from the first position to the second position.

2. The drilling tool of claim 1, further comprising a plurality of hinge pins, wherein the plurality of hinge pins pivotally couple the plurality of extendable arms with the tool body.

3. The drilling tool of claim 1, further comprising a plurality of shear pins, wherein the plurality of shear pins are operable to secure the plurality of extendable arms in the first position unless a force exerted upon the shear pins exceeds a minimum force necessary to shear the shear pins.

4. The drilling tool of claim 1, further comprising:

a rigid sleeve disposed within the expandable bladder; and wherein the rigid sleeve is operable to isolate the expandable bladder from increasing pressure.

5. The drilling tool of claim 4, further comprising:

at least one port in the rigid sleeve;

a rupture disk operable to cover the port; and wherein the rupture disk is operable to burst upon exposure to a minimum force.

6. The drilling tool of claim 4, further comprising:

at least one port in the rigid sleeve; and a piston operable to cover the port.

7. The drilling tool of claim 1, further comprising a ball-type activation mechanism operable to isolate the expandable bladder from increasing pressure.

8. The drilling tool of claim 1, wherein the extendable arms include cutting elements.

9. The drilling tool of claim 8, wherein the cutting elements include polycrystalline diamond compacts.

10. The drilling tool of claim 1, wherein the extendable arms include stabilizing lugs.

11. The drilling tool of claim 10, wherein the stabilizing lugs include wear-resistant surfaces.

12. The drilling tool of claim 10, wherein the stabilizing lugs include wear-resistant elements.

13. The drilling tool of claim 12, wherein the wear-resistant elements include diamonds or tungsten carbide inserts.

14. A method for operation of a drilling tool, comprising:

expanding an expandable bladder at least partially disposed within a tool body to engage a plurality of extendable arms pivotally coupled with the tool body, the tool body defining an interior cavity and having a generally cylindrical exterior surface;

deploying the plurality of extendable arms from a first position to a second position;

wherein the extendable arms are retracted with respect to the exterior surface of the tool body in the first position and extended with respect to the exterior surface of the tool body in the second position; and wherein expanding the expandable bladder forces the extendable arms pivotally outward with respect to the tool body.

15. The method of claim 14, further comprising shearing a plurality of shear pins, the plurality of shear pins being operable to secure the extendable arms in the first position unless a force exerted upon the shear pins exceeds a minimum force.

16. The method of claim 14, further comprising isolating the expandable bladder from pressure until activation.

17. The method of claim 16, wherein isolating the expandable bladder includes disposing a rigid sleeve within the expandable bladder; and wherein the rigid sleeve includes at least one port that provides a path of fluid communication between an inner region of the interior cavity and the expandable bladder.

18. The method of claim 17, wherein a rupture disk at least temporarily seals the port; and wherein the rupture disk is operable to burst upon exposure to a minimum force.

19. The method of claim 17, wherein a piston at least temporarily seals the port.

20. The method of claim 14, wherein:

the expandable bladder is expanded by increasing a back pressure within the tool body;

the back pressure within the tool body is increased by increasing a flow-rate of a drilling fluid; and the drilling fluid continuously flows through the tool body.

21. A drilling tool, comprising:

a tool body, the tool body defining an interior cavity and having a generally cylindrical exterior surface;

a plurality of extendable arms being coupled with the tool body;

the extendable arms each having a first position in which the extendable arms are retracted with respect to the exterior surface of the tool body, and a second position in which the extendable arms are extended with respect to the exterior surface of the tool body;

an expandable bladder at least partially disposed within the interior cavity of the tool body;

wherein the expandable bladder is operable to deploy the plurality of extendable arms from the first position to the second position;

the tool body having a first end adapted to be coupled to an upstream portion of a drilling string; and wherein the expandable bladder is operable to deploy the plurality of extendable arms in response to an increase of a back pressure of a drilling fluid flowing through the interior cavity of the tool body from the first end through the second end.

* * * * *

UNITED STATES PATENT AND TRADEMARK OFFICE

CERTIFICATE OF CORRECTION

PATENT NO. : 6,973,978 B2
APPLICATION NO. : 10/422010
DATED : December 13, 2005
INVENTOR(S) : Philippe Louis Cravatte It is certified that error appears in the above-identified patent and that said Letters Patent is hereby corrected as shown below:

| | |
|---|---|
| Column 8, line 32, Claim 21 | Replace "the tool body having a first end adapted to be coupled to an upstream portion of a drilling string; and" |
| | With --the tool body having a first end adapted to be coupled to an upstream portion of a drilling string; the tool body having a second end adapted to be coupled to a downstream portion of the drilling string; and-- |

Signed and Sealed this

Seventeenth Day of April, 2007

JON W. DUDAS
*Director of the United States Patent and Trademark Office*